US005344741A

United States Patent [19]

Iwata et al.

[11] Patent Number: 5,344,741

[45] Date of Patent: Sep. 6, 1994

[54] METHOD FOR PHOTOGRAPHIC DEVELOPMENT

[75] Inventors: Tamotu Iwata; Seiichi Sumi, both of Nagaokakyo, Japan

[73] Assignee: Mitsubishi Paper Mills Limited, Tokyo, Japan

[21] Appl. No.: 158,493

[22] Filed: Nov. 29, 1993

Related U.S. Application Data

[63] Continuation of Ser. No. 811,621, Dec. 23, 1991, abandoned.

[30] Foreign Application Priority Data

Dec. 26, 1990 [JP] Japan ..... 2-414780

[51] Int. Cl.[5] ..... G03C 5/315

[52] U.S. Cl. ..... 430/265; 430/264; 430/435; 430/436; 430/438; 430/478; 430/481; 430/482; 430/486; 430/487

[58] Field of Search ..... 430/264, 265, 435, 436, 430/438, 478, 481, 482, 486, 487

[56] References Cited

U.S. PATENT DOCUMENTS

| | | | |
|---|---|---|---|
| 3,938,997 | 2/1976 | Fisch et al. | 430/468 |
| 4,269,929 | 5/1981 | Nothnagle | 430/264 |
| 4,385,108 | 5/1983 | Takagi et al. | 430/264 |
| 4,429,036 | 1/1984 | Hirano et al. | 430/264 |
| 4,693,956 | 9/1987 | Marchesano | 430/268 |
| 4,756,997 | 7/1988 | Marchesano | 430/266 |
| 5,120,637 | 6/1992 | Furusawa et al. | 430/546 |

FOREIGN PATENT DOCUMENTS 203521 12/1986 European Pat. Off. .

*Primary Examiner*—Hoa Van Le

*Attorney, Agent, or Firm*—Cushman, Darby & Cushman

[57] ABSTRACT

The present invention provides a developer for silver halide photographic light-sensitive materials which provides super-high contrast and is improved in stability with time. This developer contains at least (1) a developing agent, (2) 10 g/l or more of a hydroquinonemonosulfonate, (3) 0.3 mol/l or more of a sulfite and (4) an amino compound in an amount necessary to accelerate enhancement of contrast and has a pH of 10.5–12.3.

6 Claims, No Drawings

METHOD FOR PHOTOGRAPHIC DEVELOPMENT

This is a continuation of application Ser. No. 07/811,621, filed on Dec. 23, 1991, which was abandoned upon the filing hereof.

BACKGROUND OF THE INVENTION

The present invention relates to a method for development of silver halide photographic light-sensitive materials and in particular, to a method of development by which a useful high-contrast image can be stably obtained in the field of photomechanical process in graphic art printing.

In the field of photomechanical process, an image forming system which gives a photographic characteristic of high contrast (at least 10 in gamma value) is necessary for satisfactory reproduction of continuous tone images by dot images or for satisfactory reproduction of line images. Hitherto, for this purpose, a special developer called lith developer utilizing "infectious development" has been used, but this developer is highly susceptible to oxidation with air and has the defect of inferior stability with time since concentration of sulfites in this developer is much reduced (because a sulfite of high concentration hinders "infectious development").

Recently, there have been practically employed methods for obtaining high-contrast images by developing silver halide light-sensitive materials with a developer high in concentration of sulfite in the presence of hydrazine derivatives of amino compounds. For example, U.S. Pat. Nos. 4,224,401, 4,168,977, 4,166,742, 4,311,781, 4,272,606, 4,221,857, and 4,243,739 disclose methods of using hydrazine derivatives. Japanese Patent Kokai Nos. 56-106244, 61-267759, 60-258537, 61-230145, 62-211647 and 2-50150 disclose methods of developing with a developer containing an amino compound in the presence of a hydrazine derivative.

According to these methods, photographic characteristics of high contrast and high sensitivity can be obtained and besides, sulfite can be added to the developer in a high concentration and therefore, stability of the developer against oxidation with air is much improved than that of lith developer.

Addition of an amino compound to developer enhances activity of the developer, can accelerate the effect of hydrazine derivative to enhance high-contrast with a developer having a lower pH value than when no amino compound is added, and contributes to stabilization of the developer and rapid processing. However, since this effect of hydrazine derivative and amino compound to attain superhigh contrast is easily exhibited in the area where pH of the developer is higher than pH of conventional developer (11.0–12.3), they are, in many case, used in that pH range. Therefore, the diveloper is inferior to conventional developers in stability with time.

SUMMARY OF THE INVENTION

The object of the present invention is to provide a superhigh contrast developer improved in stability with time.

The above object of the present invention has been attained by a method for forming a high contrast negative image by developing an exposed negative type silver halide photographic light-sensitive material in the presence of hydrazine derivatives wherein the development is carried out with a developer which contains at least (1) a developing agent, (2) 10 g/l or more of a hydroquinonemonosulfonate, (3) 0.3 mol/l or more of a sulfite, and (4) an amino compound in an amount to accelerate enhancement of contrast and which has a pH of 10.5–12.3.

The inventors have found that stability with time of a developer can be improved by using a hydroquinonemonosulfonate with other developing agents (developing agents other than hydroquinonemonosulfonates). The hydroquinonemonosulfonate has already been known as a developing agent, but the effect that stability with time of developer is improved by using it with other developing agents is unexpectable from conventional techniques.

DESCRIPTION OF THE INVENTION

The hydroquinonemonosulfonate of the present invention includes hydroquinonemonosulfonic acid and/or salts thereof (such as Na, K and $NH_4$ salts). Addition amount thereof is 10 g/l or more to exhibit its effect. It can be added up to the limit of dissolution though depending on concentration of the processing agent. Preferred is 20–60 g/l.

The developing agents other than the hydroquinonemonosulfonates used in the present invention have no special limitation, but dihydroxybenzenes are preferred for easily obtaining superior dot quality and a combination of dihydroxybenzenes with 3-pyrazolidones and/or p-aminophenols is preferred from the point of developability.

The dihydroxybenzene developing agents used in the present invention include, for example, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Among them, especially preferred is hydroquinone.

The developing agents of 3-pyrazolidones or derivatives thereof used in the present invention include, for example, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone. The p-aminophenol developing agents used in the present invention include, for examine, N-methyl-p-aminophenol, N-(β-hydroxyethyl)-p-aminophenol, N-(4-hydroxyphenyl)glycine, 2-methyl-p-aminophenol, and p-benzylaminophenol. Among them, especially preferred is N-methyl-p-aminophenol.

The developing agent is used preferably in an amount of 0.1–0.8 mol/l. When the combination of dihydroxybenzenes and 1-phenyl-3-pyrazolidones or p-aminophenols is employed, it is preferred to use the former in an amount of 0.1–0.5 mol/l and the latter in an amount of 0.06 mol/l or less.

The sulfites used as a preservative in the present invention include, for example, potassium sulfite, ammonium sulfite, sodium hydrogensulfite, potassium hydrogenmetasulfite, and sodium formalde-hydehydrogensulfite. This is used in an amount of at least 0.3 mol/l. If the amount is less than 0.3 mol/l, preservability cannot be kept at a practical level. Upper limit of the amount is desirably 1.0 mol/l or less. If it is more than this amount, the sulfite is precipitated in the developer or it increases silver sludge.

The amino compounds used in the present invention have the effect to accelerate enhancement of contrast in the presence of hydrazine derivatives. As these amino compounds, there may be used those which are described in Japanese Patent Kokai Nos. 56-106244, 61-267759, 61-230145, 62-211647, 2-50150 and 2-208652.

Examples of the amino compounds are enumerated below.

I-1) N-n-butyldiethanolamine
I-2) 3-Diethylamino-l,2-propanediol
I-3) 2-Diethylamino-l-ethanol
I-4) 2-Diethylamino-l-butanol
I-3-Diethylamino-l,2-propanediol
I-6) 3-Diethylamino-l-propanol
I-7) 3-Diethylamino-l-propanol
I-B) Triethanolamine
I-9) 3-Dipropylamino-l,2-propanediol
I-10) 2-Dioctylamino-l-ethanol
I-11) 3-Amino-l,2-propanediol
I-12) 1-Dithylamino-2-propanol
I-13) n-Propyldiethanolamine
I-14) 2-Di-isopropylaminoethanol
I-15) N,N-di-n-butylethanolamine
I-16) 3-Di-propylamino-l,2-propanediol
I-17) 2-Methylamino-l-ethanol
I-18) 3-Dimethylamino-l,2-propanediol
I-19) 4-Dimethylamino-l-butanol
I-20) 1-Dimethylamino-2-butanol
I-21) 1-Dimethylamino-2-hexanol
I-22) 5-Dimethylamino-l-pentanol
I-23) 6-Dimethylamino-l-hexanol
I-24) 1-Dimethylamino-2-octanol
I-25) 6-Dimethylamino-l,2-hexanediol Amount of the amino compounds may be such that enhancement of contrast can be accelerated by the addition, but is generally 0. 005–1.0 mol/l.

pH of the developer of the present invention is set at 10.5–12.3. Alkali agents used for setting the pH value include pH adjusters and buffers such as sodium hydroxide, potassium hydroxide, sodium carbonate, potassium carbonate, sodium tertiary phosphate, potassium tertiary phosphate, sodium silicate, and potassium silicate. As the buffers, there may also be used boron compounds described in Japanese Patent Kokai No.62-186259 and compounds having a dissociation constant of $1=10^{-11}$–$3\times10^{-13}$ described in Japanese Patent Kokai No. 60-93433.

Additives other than the above components used include, for example, sodium bromide, potassium bromide, sodium chloride, potassium chloride, potassium iodide, ethylene glycol, diethylene glycol, triethylene glycol, and polyethylene glycol mentioned in Japanese Patent Kokai No.61-290448; mercapto compounds such as 1-phenyl-5-mercaptotetrazole and indazoles such as 5-nitroindazole as antifoggants; sodium 2-mercaptobenzimidazole-5-sulfonate and derivatives thereof mentioned in Japanese Patent Kokai No.56-24347 as sludge inhibitors; and 3-(5-mercaptotetrazole)benzenesulfonic acid and derivatives thereof mentioned in Japanese Patent Kokai No.62-212651 as uneven development inhibitors.

As dissolving aids for the amino compounds, there may be added compounds having sulfonic acid group or carboxyl group such as sodium p-toluenesulfonate, sodium benzenesulfonate, sodium 1-hexanesulfonate, sodium p-toluylate, sodium isobutyrate, sodium benzoate, sodium caproate, sodium n-caprylate, and sodium n-caprate.

As fixers, there may be used those which have the compositions generally employed. The fixers can contain fixing agents such as sodium thiosulfate and ammonium thiosulfate, hardeners such as water-soluble aluminum salts such as aluminum sulfate, aluminum chloride and potash alum, precipitation inhibitors for aluminum such as dibasic acids, e.g., tartaric acid, potassium tartrate, sodium tartrate, sodium citrate, lithium citrate and potassium citrate, preservatives such as sulfites and hydrogensulfites, and pH buffers such as acetic acid and boric acid. pH of the fixers is generally at least 3.8, preferably 4.5–5.0 in view of stability of fixers.

Development temperature is normally in the range of 18°–50° C. and preferably 25°–40° C. The method for development according to the present invention is suitable for rapid processing which is carried out by automatic processors and the automatic processors can be roller conveying type, belt conveying type and any other types. Processing time can be short and total processing time is 3 minutes or less and development processing time is 15–60 seconds, preferably 20–40 seconds.

Hydrazine derivatives used in the development according to the present invention include, for example, hydrazine sulfate and hydrazine hydrochloride, and besides hydrazine derivatives mentioned in U.S. Pat. Nos. 4,224,401, 4,243,734, 4,272,614, 4,385,108, 4,269,929, and 4,323,643, and Japanese Patent Kokai Nos. 56-106244, 61-267759, 61-230145, 62-270953, 62-178246, 62-180361, 62-275247, 63-253357, 63-265239, 1-92356 and 1-99822.

The above hydrazine derivatives may be contained in a developer or an emulsion layer of light-sensitive materials or a layer contiguous to the emulsion layer. When the hydrazine derivatives are contained in the developer, amount thereof is from 5 mg to 5 g for 1 liter and when they are contained in the light-sensitive materials, amount thereof is $1\times10^{-6}$–$5\times10^{-2}$ mol, preferably $1\times10^{-5}$–$2\times10^{-2}$ mol for 1 mol of silver.

In the preferred embodiment of the present invention, the hydrazine derivatives are preferably contained in the light-sensitive materials.

Examples of the hydrazine derivatives which are not limitative are shown below.

Compound (1)

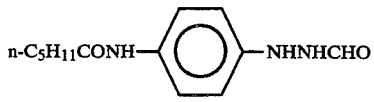

-continued
Compound (2)
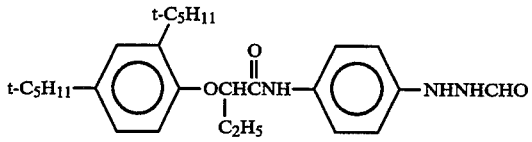
Compound (3)
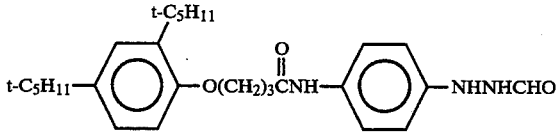
Compound (4)
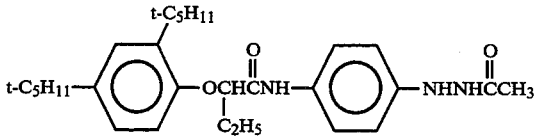
Compound (5)
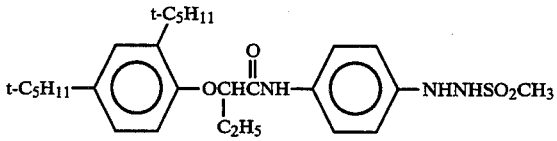
Compound (6)
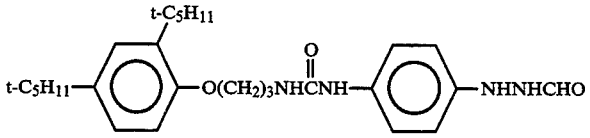
Compound (7)
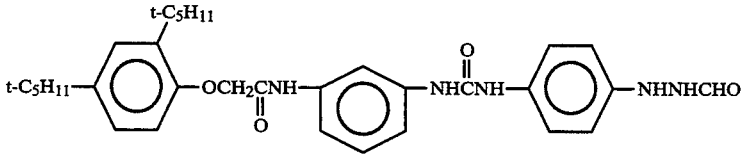
Compound (8)
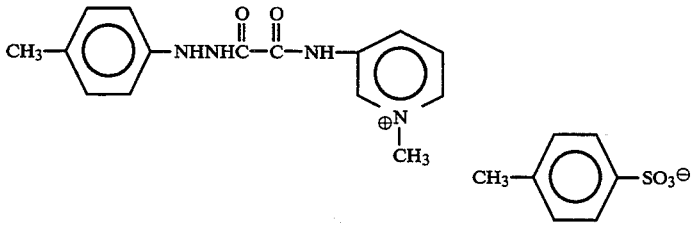
Compound (9)
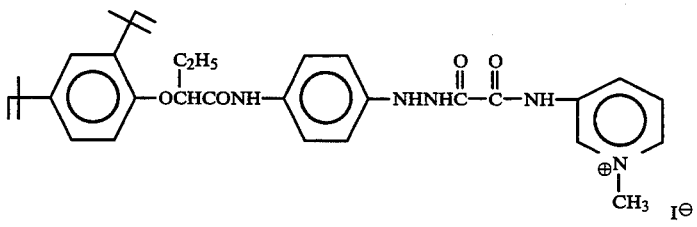

-continued
Compound (10)
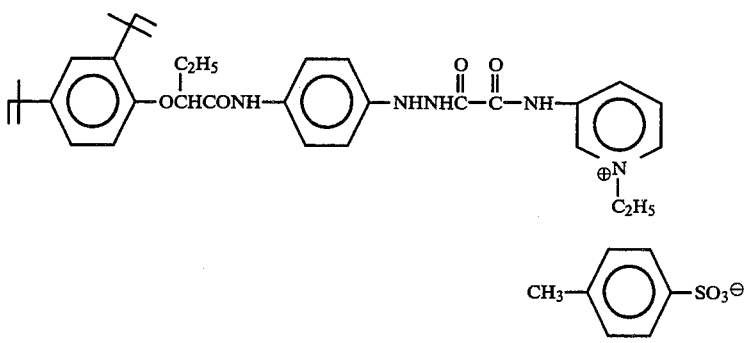
Compound (11)
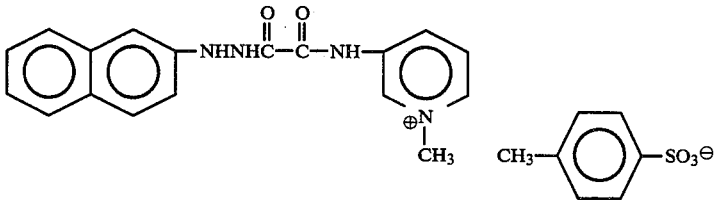
Compound (12)
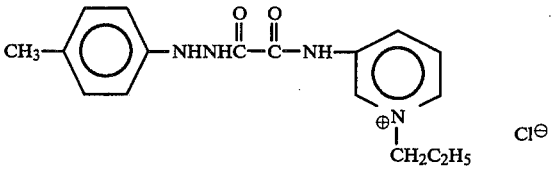
Compound (13)
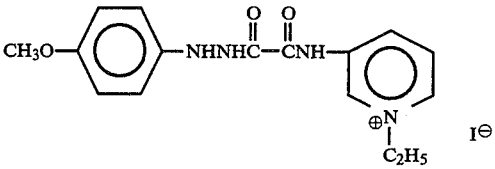
Compound (14)
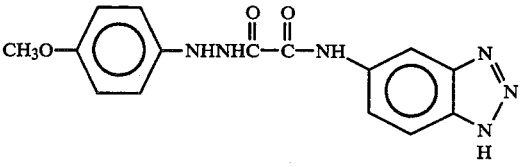
Compound (15)
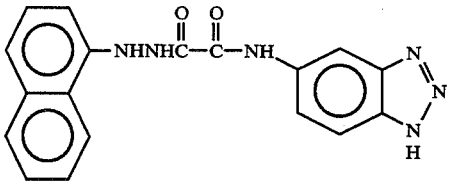
Conpound (16)
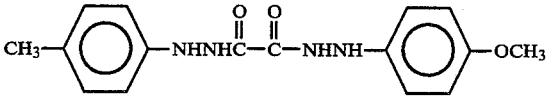
Compound (17)
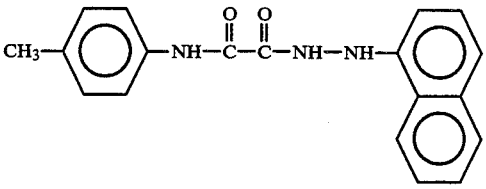

-continued

Compound (18)

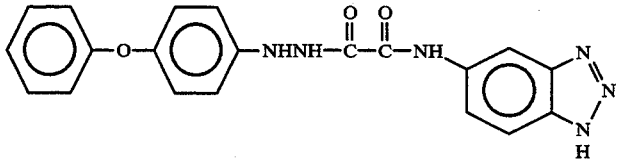

Compound (19)

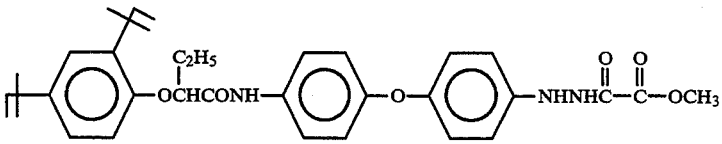

Compound (20)

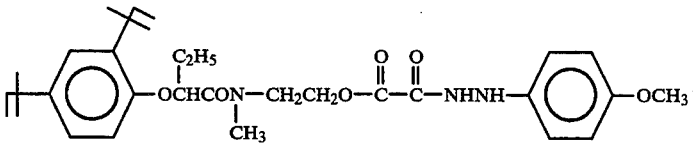

Compound (21

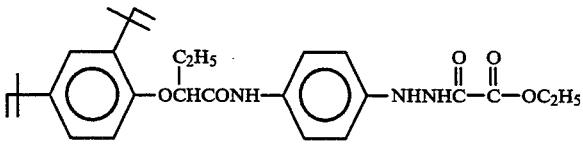

Compound (22)

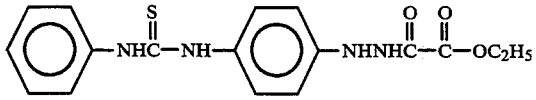

Compound (23)

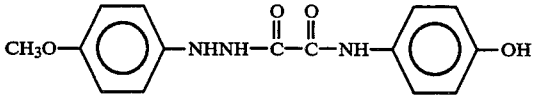

Compound (24)

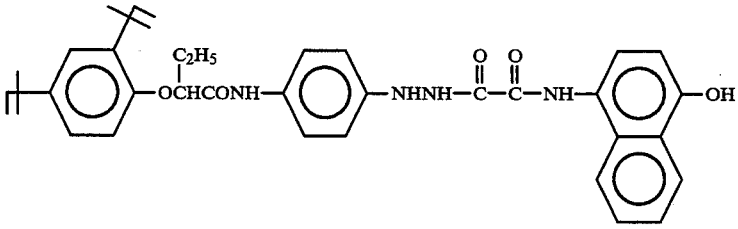

Compound (25)

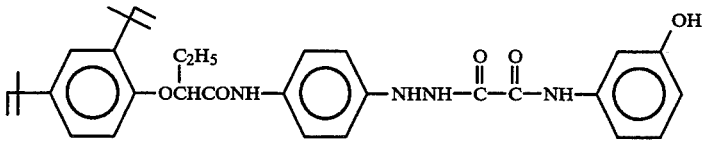

Compound (26)

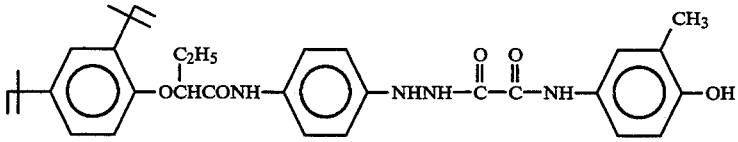

Silver halide emulsions for the light-sensitive materials used in the present invention include any commonly used ones such as silver bromide, silver iodobromide, silver iodochloride, silver chlorobromide and silver chloride. Silver halide grains used for the silver halide emulsions may be prepared by any of acidic process, neutral process and ammonia process. Grains of the silver halides may be those which have regular crystal forms such as cubic form, octahedral form and tetradecahedral form or may be those which have irregular forms such as spherical form and platy form. Average grain size of silver halide grains can be in the range of 0 05–15 micron. Grain size distribution is not limitative, but preferably has a narrow distribution. Especially preferred is a monodispersed emulsion (having a value of 0.20 or less which is a quotient obtained by dividing standard deviation of grain size distributions by average grain size).

To the silver halide emulsions used in the present invention, there may be added metal salts such as cadmium salts, zinc salts, lead salts, thallium salts, iridium salts and rhodium salts during preparation or growth of silver halide grains.

The silver halide emulsions may or may not be chemically sensitized. Chemical sensitization includes sulfur sensitization, reduction sensitization, noble metal sensitization and combinations thereof, and any of these sensitizations can be employed.

As binders (or protective colloids) for the light-sensitive materials of the present invention, there may be used gelatin, gelatin derivatives, graft polymers of gelatin with other polymers, other proteins, sugar derivatives, cellulose derivatives, various synthetic hydrophilic polymer materials such as homopolymers and copolymers. Examples of these binders are albumin, casein, hydroxyethylcellulose, carboxymethylcellulose, cellulose sulfate, sodium alginate, polyvinyl alcohol, poly-N-vinylpyrrolidone, polyacrylic acid, polymethacrylic acid, polyvinylimidazole, sodium polystyrenesulfonate, styrene-maleic anhydride copolymer and sodium styrenesulfonate-sodium maleate copolymer.

The silver halide emulsions used in the present invention can be spectrally sensitized with dyes known as sensitizing dyes in the photographic field. These dyes include cyanine dyes, merocyanine dyes, hemicyanine dyes, styryl dyes, and hemioxanole dyes.

Stabilizers, antifoggants and the like can be added to the silver halide emulsions during preparation of the emulsions for stably maintaining the photographic characteristics. These additives (stabilizers, antifoggants) include azoles, nitroimidazoles, nitroindazoles, nitrobenzimidazoles, benzimidazoles, mercaptothiazoles, mercaptobenzothiazoles, mercaptothiadiazoles, mercaptobenzimidazoles, aminotriazoles, benzotriazoles, mercaptotetrazoles, mercaptotriazoles, and azaindenes.

Layers of the light-sensitive materials of the present invention (emulsion layer, intermediate layer, over layer and other hydrophilic colloid layers) can be hardened. As hardeners, inorganic and organic hardeners which are known in this field can be used.

The photographic emulsion layer and other hydrophilic colloid layers can contain synthetic polymer latexes for improving dimensional stability. These include synthetic polymer latexes of alkyl (meth)acrylates, acrylates, (meth)acrylamides, vinyl acetate, styrene, acrylonitrile, acrylic acid, styrenesulfonic acid, $\alpha,\beta$-unsaturated dicarboxylic acids, hydroxyalkyl (meth)acrylates and others alone or in combination.

The photographic materials of the present invention are coated on suitable photographic supports. These supports include, for example, baryta papers, polyethylene-coated papers, polypropylene synthetic papers, and polyethylene terephthalate films.

The photographic emulsion layer and other hydrophilic colloid layers may contain coating aids and surface active agents for antistatic purpose, improvement of slipperiness and inhibition of adhesion.

The present invention will be explained in more detail by the following examples.

EXAMPLE 1

A gelatino silver chloride emulsion comprising cubic crystal of 0.1 micron in average grain size was prepared by double-jet method and demineralized by flocculation method, washed with water and redissolved. To this emulsion was added the hydrazine derivative of Compound (6) exemplified above in an amount of 4 mg per 1 g of silver nitrate and were further added 1-phenyl-5-mercaptotetrazole, polyethyl acrylate latex, 2-hydroxy-4,6-dichloro-1,3,5-triazine sodium salt and sodium dodecylbenzenesulfonate. This emulsion was coated on a polyethylene terephthalate film at a silver amount (in terms of silver nitrate) of 5 g/m$^2$ and a gelatin amount of 3 g/m$^2$. On this emulsion layer was coated a protective layer comprising 0.8 g/m$^2$ of gelatin, 80 mg/m$^2$ of a yellow dye having an absorption maximum in 400–450 nm (such as Oxonol Yellow of Hoechst Inc.), a surface active agent and a hardener. This film was named Film A.

This film was exposed through a sensitometric wedge by a roomlight printer (P-627FM manufactured by Dainippon Screen Mfg. Co., Ltd.) and then was developed with developers having the compositions containing the hydroquinonemonosulfonates as shown in the following Table 1 and comparative developers having the compositions as shown in the following Table 1 at 38° C. for 20 seconds. Then, this film was fixed, washed with water and dried. An automatic processor (LD-221QT manufactured by Dainippon Screen Mfg. Co., Ltd.) was employed for this processing.

TABLE 1

| | Compositions of developers | | | | | |
|---|---|---|---|---|---|---|
| Developer | (A) Comparative | (B) The present invention | (C) The present invention | (D) The present invention | (E) Comparative | (F) The present invention |
| Sodium ethylenediaminediacetate | 1 | " | " | " | " | " |
| Sodium hydroxide | 48.3 | " | " | " | " | " |
| Postassium sulfite | 108 | " | " | " | " | " |
| Hydroquinone | 55 | " | " | " | " | 55 |
| N-methyl-p-aminophenol ½ sulfate | 0.4 | " | " | " | " | " |
| Potassium hydroquinonemonosulfonate | — | 10 | 30 | 60 | — | 30 |
| Potassium bromide | 4 | " | " | " | " | " |
| 5-methylbenzotriazole | 0.4 | " | " | " | " | " |
| 2-mercaptobenzimidazole-5-sulfonic acid | 0.2 | " | " | " | " | " |
| Sodium 3-(5-mercaptotetrazole)-benzenesulfonate | 0.2 | " | " | " | " | " |
| 4-Dimethylamino-1-butanol | 13 | " | " | " | — | — |
| N-n-butyldiethanolamine | — | — | — | — | 13 | " |
| pH (adjusted) | 11.85 | " | " | " | " | " |

TABLE 1-continued

| Developer | Compositions of developers (A) Comparative | (B) The present invention | (C) The present invention | (D) The present invention | (E) Comparative | (F) The present invention |
|---|---|---|---|---|---|---|
| Total amount (with addition of water) | 1 l | " | " | " | " | " |

Addition amounds of the components are shown by g/l.

EXAMPLE 2

An emulsion comprising cubic crystal of 0.25 $\mu$ in average grain size having the halogen composition of AgCl 0.4 mol%, AgI 0.4 mol% and AgBr 99.2 mol% was prepared by double-jet method and demineralized by flocculation method, washed with water and redissolved and was suitably chemically sensitized with sodium thiosulfate. To this emulsion were added anhydro-5,5-dichloro-9-ethyl-3,3'-bis(3-sulfopropyl)oxacarbocyanine hydroxide sodium salt (sensitizing dye) in an amount of 2 mg per 1 g of silver nitrate and the hydrazine derivative of Compound (2) in an amount of 5 mg per 1 g of silver nitrate and were further added 5-methylbenzotriazole, 4-hydroxy-6-methyl-1,3,3a,7-tetrazaindene, 2-hydroxy-4,6-dichloro-1,3,5-triazine sodium salt and sodium dodecylbenzenesulfonate. This emulsion was coated on a polyethylene terephthalate film at a silver amount (in terms of silver nitrate) of 6 g/m$^2$ and a gelatin amount of 3 g/m$^2$.

On this emulsion layer was provided a gelatin layer containing a surface active agent (sodium dodecylbenzensulfonate) and a hardener (2-hydroxy-4,6-dichloro-1,3,5-triazine sodium salt) at a gelatin amount of 1 g/m$^2$. This film was named Film B.

This film was exposed to tungsten light source through a sensitometric wedge and processed in the same manner as in Example 1.

The results are shown in Table 2.

The sensitivity in Table 2 is relatively shown when the reciprocal value of exposure required for obtaining a transmission density of 3.0 with using the comparative developer (A) is assumed to be 100 for the developers (B), (C) and (D) of the present invention and similarly when the reciprocal value of exposure required for obtaining a transmission density of 3.0 with using the comparative developer (E) is assumed to be 100 for the developer (F) of the present invention. $\gamma$ means tan $\theta$ when a straight line is drawn to link the points of density 0.1 and density 3.0 on the characteristic curve. The storage stability of developer with time is a photographic characteristic obtained with using the developer which was left for 4 days without replenishing after used for processing.

TABLE 2

| Developer | | Light-sensitive material | Photographic characteristics: Sensitivity | $\gamma$ | Maximum density | Minimum density | Photographic characteristics (after lapse of 4 days): Sensitivity | $\gamma$ | Maximum density | Minimum density | State of developer |
|---|---|---|---|---|---|---|---|---|---|---|---|
| (A) | Comparative | Film A | 100 | 11.4 | 5.20 | 0.05 | 62 | 6.5 | 5.00 | 0.05 | Colored blackish brown. |
| (B) | The present invention | " | 102 | 11.5 | 5.40 | 0.05 | 96 | 11.0 | 5.30 | 0.05 | Slightly colored blackish brown. |
| (C) | " | " | 105 | 12.4 | 5.50 | 0.05 | 106 | 12.2 | 5.57 | 0.05 | Substantially no coloration. |
| (D) | " | " | 108 | 13.1 | 5.88 | 0.04 | 107 | 12.8 | 5.72 | 0.05 | Substantially no coloration. |
| (E) | Comparative | " | 100 | 11.8 | 5.40 | 0.04 | 58 | 7.2 | 5.10 | 0.05 | Colored blackish brown. |
| (F) | The present invention | " | 112 | 13.5 | 5.50 | 0.04 | 109 | 13.3 | 5.46 | 0.04 | Substantially no coloration. |
| (A) | Comparative | Film B | 100 | 13.5 | 4.60 | 0.05 | 55 | 8.6 | 4.45 | 0.05 | Colored blackish brown. |
| (B) | The present invention | " | 103 | 14.3 | 4.80 | 0.04 | 93 | 13.8 | 4.70 | 0.05 | Slightly colored blackish brown. |
| (C) | " | " | 104 | 16.5 | 5.23 | 0.04 | 100 | 15.9 | 5.21 | 0.05 | Substantially no coloration. |
| (D) | " | " | 109 | 18.2 | 5.31 | 0.05 | 110 | 18.0 | 5.29 | 0.05 | Substantially no coloration. |
| (E) | Comparative | " | 100 | 14.0 | 4.71 | 0.05 | 68 | 7.8 | 4.60 | 0.05 | Colored blackish brown. |
| (F) | The present invention | " | 109 | 17.2 | 5.10 | 0.05 | 105 | 16.8 | 5.13 | 0.05 | Substantially no coloration. |

As shown in Table 2, the comparative developers which did not contain potassium hydroquinonemonosulfonate colored blackish brown with lapse of 4 days and reduced sensitivity and lowered contrast and thus considerably deteriorated the pohotographic characteristics. On the other hand, the developers of the present invention were quite a little in coloration and change of photographic characteristics.

What is claimed is:

1. A method for forming a high-contrast negative image which comprises developing an exposed negative type silver halide photographic light-sensitive material with a developer in the presence of a hydrazine derivative wherein said developer contains at least (1) 0.1–0.8 mol/l a developing agent, (2) 20–60 g/l of a hydroquinonemonosulfonate, (3) 0.3 mol/l or more of a sulfite and (4) an amino compound which in the presence of said hydrazine derivative, accelerates enhancement of contrast said amino compound being present in an amount of 0.005–1.0 mol/l and has a pH of 10.5–12.3.

2. A method according to claim 1, wherein the hydroquinonemonosulfonate is hydroquinonemonosulfonic acid and/or a salt thereof.

3. A method according to claim 1, wherein the developing agent (1) is a dihydroxybenzene developing agent or a combination of a dihydroxybenzene developing agent with a 3-pyrazolidone developing agent and/or a p-aminophenol developing agent.

4. A method according to claim 1, wherein the hydrazine derivative is contained in the developer or the light-sensitive material.

5. The method of claim 1 wherein the amino compound is an amino alcohol.

6. The method of claim 5 wherein the amino alcohol is present in an amount of 0.005–1.0 mol/l.

* * * * *